US009739482B2

(12) United States Patent
Colin et al.

(10) Patent No.: US 9,739,482 B2
(45) Date of Patent: Aug. 22, 2017

(54) PREMIXING-LESS POROUS HYDROGEN BURNER

(75) Inventors: Jerome Colin, Versailles (FR); Andre Nicolle, Puteaux (FR); Willi Nastoll, Les Roches de Condrieu (FR)

(73) Assignee: IFPEN, Rueil-Malmaison (FR)

( * ) Notice: Subject to any disclaimer, the term of this patent is extended or adjusted under 35 U.S.C. 154(b) by 1644 days.

(21) Appl. No.: 12/528,487

(22) PCT Filed: Feb. 14, 2008

(86) PCT No.: PCT/FR2008/000207

§ 371 (c)(1),
(2), (4) Date: Sep. 27, 2010

(87) PCT Pub. No.: WO2008/122707

PCT Pub. Date: Oct. 16, 2008

(65) Prior Publication Data

US 2011/0027739 A1 Feb. 3, 2011

(30) Foreign Application Priority Data

Feb. 26, 2007 (FR) ..... 06 10999

(51) Int. Cl.

| | |
|---|---|
| ***F23D 3/40*** | (2006.01) |
| ***F23D 14/12*** | (2006.01) |
| ***F23D 5/00*** | (2006.01) |
| ***F23D 14/20*** | (2006.01) |
| ***F23C 13/00*** | (2006.01) |
| ***F23C 99/00*** | (2006.01) |
| *E21B 36/00* | (2006.01) |

(52) U.S. Cl.

CPC ..... *F23D 14/20* (2013.01); *F23C 13/00* (2013.01); *F23C 99/006* (2013.01); *F23C 2900/9901* (2013.01); *F23D 2203/105* (2013.01); *F23D 2203/1012* (2013.01)

(58) Field of Classification Search

USPC ..... 431/7, 10, 215, 247, 261, 328, 350, 354
See application file for complete search history.

(56) References Cited

U.S. PATENT DOCUMENTS

| | | | | | |
|---|---|---|---|---|---|
| 2,170,139 | A * | 8/1939 | Goodale | F23D 14/10 | 122/156 |
| 2,858,729 | A * | 11/1958 | Keyes | 356/315 | |
| 3,113,623 | A * | 12/1963 | Krueger | E21B 36/02 | 166/59 |
| 3,425,675 | A * | 2/1969 | Twine | 432/199 | |
| 4,381,913 | A * | 5/1983 | Craig et al. | 431/264 | |
| 4,400,152 | A * | 8/1983 | Craig et al. | 431/328 | |

(Continued)

FOREIGN PATENT DOCUMENTS

| | | |
|---|---|---|
| DE | 251567 C | 10/1912 |
| DE | 251567 W | 10/1912 |

(Continued)

*Primary Examiner* — Steven B McAllister
*Assistant Examiner* — Desmond C Peyton
(74) *Attorney, Agent, or Firm* — Millen White Zelano & Branigan, P.C.

(57) ABSTRACT

This invention describes a new porous hydrogen burner that is intended to be installed on different types of furnaces requiring a precise monitoring of the thermal flux, and in particular furnaces for steam-reforming of natural gas or naphtha.

17 Claims, 5 Drawing Sheets

(56) References Cited

U.S. PATENT DOCUMENTS

| | | | | |
|---|---|---|---|---|
| 4,793,800 | A * | 12/1988 | Vallett | F23D 14/10 122/17.1 |
| 4,900,245 | A | 2/1990 | Ahmady | |
| 5,567,141 | A * | 10/1996 | Joshi et al. | 431/8 |
| 5,810,577 | A | 9/1998 | Ledjeff | |
| 6,089,859 | A * | 7/2000 | Greiner et al. | 431/242 |
| 6,435,861 | B1 * | 8/2002 | Quick et al. | 431/328 |
| 6,729,163 | B2 * | 5/2004 | Yang et al. | 65/501 |
| 6,896,512 | B2 * | 5/2005 | Rattner et al. | 431/328 |
| 6,984,124 | B2 * | 1/2006 | Mosiewicz et al. | 431/350 |
| 7,025,940 | B2 * | 4/2006 | Shah et al. | 422/198 |
| 7,033,407 | B2 * | 4/2006 | Maruko | 48/127.9 |
| 7,040,400 | B2 * | 5/2006 | de Rouffignac | E21B 43/243 166/245 |
| 7,481,650 | B2 * | 1/2009 | Mosiewicz | F23C 6/045 126/110 B |
| 7,503,761 | B2 * | 3/2009 | Butler | F22B 7/00 122/4 D |
| 7,523,603 | B2 * | 4/2009 | Hagen et al. | 60/39.55 |
| 7,578,669 | B2 * | 8/2009 | Liu et al. | 431/7 |
| 7,762,806 | B2 * | 7/2010 | Hoenig et al. | 431/7 |
| 2003/0162141 | A1 * | 8/2003 | Hermann et al. | 431/202 |
| 2005/0153252 | A1 * | 7/2005 | Crawley | F01N 3/025 431/5 |

FOREIGN PATENT DOCUMENTS

| | | | |
|---|---|---|---|
| WO | 2004059208 | A2 | 7/2004 |
| WO | 2006071350 | A2 | 7/2006 |
| WO | 2006099034 | A1 | 9/2006 |
| WO | PCTFR2008000207 | R | 10/2008 |

* cited by examiner

PREMIXING-LESS POROUS HYDROGEN BURNER

FIELD OF THE INVENTION

The invention relates to a new porous hydrogen burner that is intended to be installed on different types of furnaces requiring a precise monitoring of the thermal flux, in particular furnaces for steam-reforming of natural gas or naphtha that are intended in particular for the production of hydrogen.

The expression hydrogen burner is to be understood in a broad sense and means that the fuel of this burner can be pure hydrogen, but more generally any gas that contains hydrogen.

The oxidizer can be any gas that contains oxygen, in particular air, but also oxygen-rich or oxygen-poor air. The oxidizer can even be pure oxygen in a special case.

This new burner returns to the category of premixing-less porous burners, because it has a porous element that separates the fuel side from the oxidizer side, whereby combustion takes place either inside the porous element or close to its outer surface.

More specifically, the burner that is the object of this invention is a porous burner within the meaning where the fuel and the oxidizer are introduced on both sides of a porous element (also called "porous" below), whereby the inner surface of the porous element is in contact with the fuel, and the outer surface of the porous element is in contact with the oxidizer.

The fuel and the oxidizer each diffuse from their sides through the porous element and come together:

- Either inside said porous element along a certain heating surface on which internal combustion will take place. This is then called radiant-mode operation or radiant-burner-mode operation.
- Or close to the outer surface of the porous element on the oxidizer side.

The advantages of a porous burner relative to a burner that produces a flame, whether this flame is a diffusion flame or a premixing flame, are:

- A reduction of pollutant emissions,
- Combustion according to a more controlled geometry than that of flame combustion that can also pose stability problems,
- Clearly improved durability of equipment because diluted combustion limits the risk of hot points,
- The possibility of incorporating within the porous element a combustion catalyst that makes it possible to lower the combustion temperature to a value that is close to 500° C.

The burner according to the invention is therefore a porous burner, without premixing, having in addition a fuel distribution element that makes it possible to monitor the thermal flux according to the primary dimension of said burner that we shall conventionally call the length of the burner.

The monitoring of the thermal flux is carried out by a set of orifices pierced on the surface of the distributor and grouped in sections. Each section groups the orifices of the same diameter.

The distribution of these orifices all along the distributor is an integral part of the invention. In general, the burner according to this invention will have a fuel distributor that has at least two sections, each section being characterized by a given orifice diameter and occupying a certain fraction of the length L of the burner.

It should be noted that the fuel and the oxidizer arrive via the two opposite sides of the porous element, and the latter does not play the role of a premixing element but on the contrary a zone for separating fuel and oxidizer.

Furthermore, the hydrodynamic conditions, and in particular the speed of the fuel in the annular space that separates the distributor from the porous element, play an important role since the stability of the flame is ensured in a limited range of flow rates. If the flow rate is too low, the flame can go out, while if the flow rate is too high, the flame can be blown out.

EXAMINATION OF THE PRIOR ART

The prior art in the field of porous burners is very extensive, and we will thus be dealing with patents that give an account of a hydrogen fuel, or, for the most part, hydrogen, by adhering to an overall cylindrical geometry.

The U.S. Pat. No. 5,810,577 describes a porous catalytic burner that comprises two combustion chambers, whereby the first combustion chamber is fed by fuel and the second chamber is fed by the combustion effluent that is obtained from the first chamber, whereby the two chambers are separated by a porous catalytic barrier that has a porosity of more than 50% and a pore size of between 1 nm and 1 mm, whereby the thickness of said barrier is between 0.05 and 10 mm.

The U.S. Pat. No. 6,699,032 describes a device for storing a fuel gas that comprises a combustion system for gases that escape through a safety valve, whereby said combustion system consists of a burner that comprises a porous element that surrounds a fuel distributor. The fuel distribution is uniform and the porous element plays the role of a diffusion zone or a mixing zone between the fuel and the oxidizer.

SUMMARY DESCRIPTION OF THE FIGURES

Figure 4:
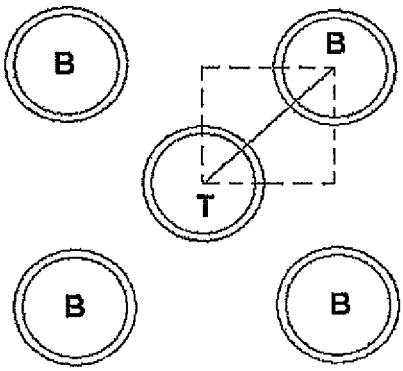

FIG. 4 provides a diagrammatic representation of an arrangement of burners according to the invention within a set of tubes to be heated.

Figure 5:
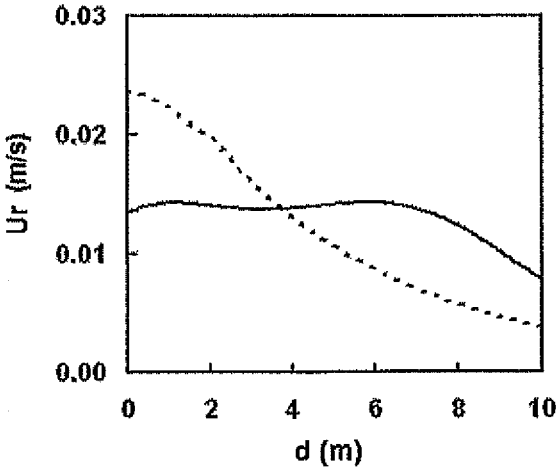

FIG. 5 is a curve that provides the variation of the radial speed of the fuel at the outer surface of the porous element along the longitudinal axis of the burner. The curve in dotted lines corresponds to a uniform orifice distribution, and the curve in solid lines corresponds to an orifice distribution according to the invention. It is presented in detail in the framework of the example below.

Figure 6:
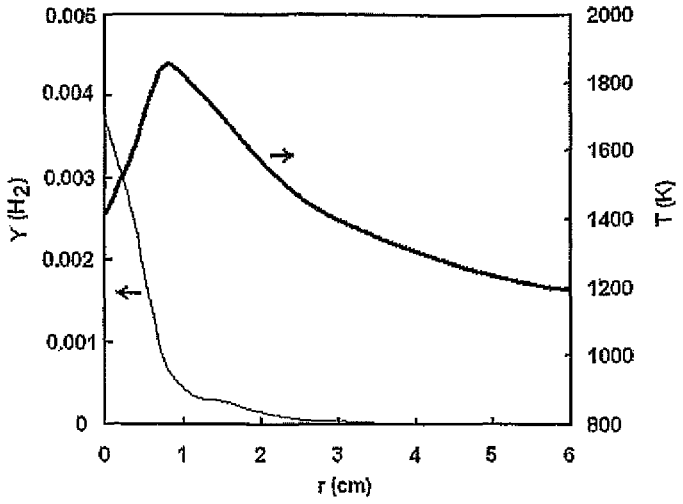

FIG. 6 shows the changes in the consumption of hydrogen Y(H2) in the direction that joins the center of the burner to that of the tube to be heated; said direction is center to center and is also presented in detail within the framework of the example below.

SUMMARY DESCRIPTION OF THE INVENTION

The hydrogen burner according to this invention is a premixing-less burner, with a cylindrical geometry of length L and of diameter D, with an L/D ratio of between 10 and 500, and preferably between 30 and 300. The burner according to the invention has a central hydrogen distributor with a non-uniform orifice distribution, and it has a porous element of annular shape that surrounds the central distributor at least over its entire length L, whereby the thickness of said porous element is between 0.1 and 2 cm, and whereby the inner surface of said porous element is located at a distance from the central distributor of between 0.5 cm and 10 cm.

The distributor of the burner according to this invention is preferably divided into a certain number of sections, whereby the length of each section varies from 10 mm to 2 m, and preferably from 20 mm to 1.5 m.

The hydrogen burner, according to this invention, preferably has a central fuel distributor, and said central distributor is preferably divided into at least two sections, whereby each section has orifices of the same diameter and whereby at least one section has orifices of a different diameter from that of the other sections.

In a more preferred manner, the central distributor is divided into at least two sections, whereby each section has orifices of an increasing diameter with the axial distance along the distributor, in the direction of flow of the fuel.

Even more preferably, the central distributor is divided into at least two sections, whereby each section has orifices of increasing diameter according to an exponential-type law, in the direction of the flow of the fuel.

The center-to-center distance of the orifices of the same section is generally between 0.5 cm and 50 cm, and preferably between 1 cm and 20 cm.

The length L of the burner is generally between 2 and 15 m, and preferably between 5 and 12 meters.

The porous element that forms an integral part of the burner according to the invention preferably has a porosity of at least 50%, and more preferably at least 80%.

In some cases, the porous element may have at least two zones of different porosity.

The fuel, generally hydrogen, is preferably introduced into the central distributor at a pressure of between 0.1 and 10 MPa.

According to a variant of the burner according to the invention, the oxidizer is preferably introduced into a first annular space that surrounds the porous element of the burner, and the combustion gases are collected in a second annular space that surrounds the first annular space.

The oxidizer preferably circulates in a direction that is essentially parallel to the longitudinal axis of the burner at a speed of between 1 m/s and 100 m/s and preferably 3 to 80 m/s.

The mean radial speed of the fuel that is related to the inner surface of the porous element is generally between 2 mm/s and 100 cm/s, and preferably between 0.5 cm/s and 10 cm/s.

The burner according to this invention can be applied to any type of furnace that requires a well-controlled heating of the tubes over their entire length, in particular in furnaces for vapor-reforming of natural gas or naphtha.

DETAILED DESCRIPTION OF THE INVENTION

Figure 1:
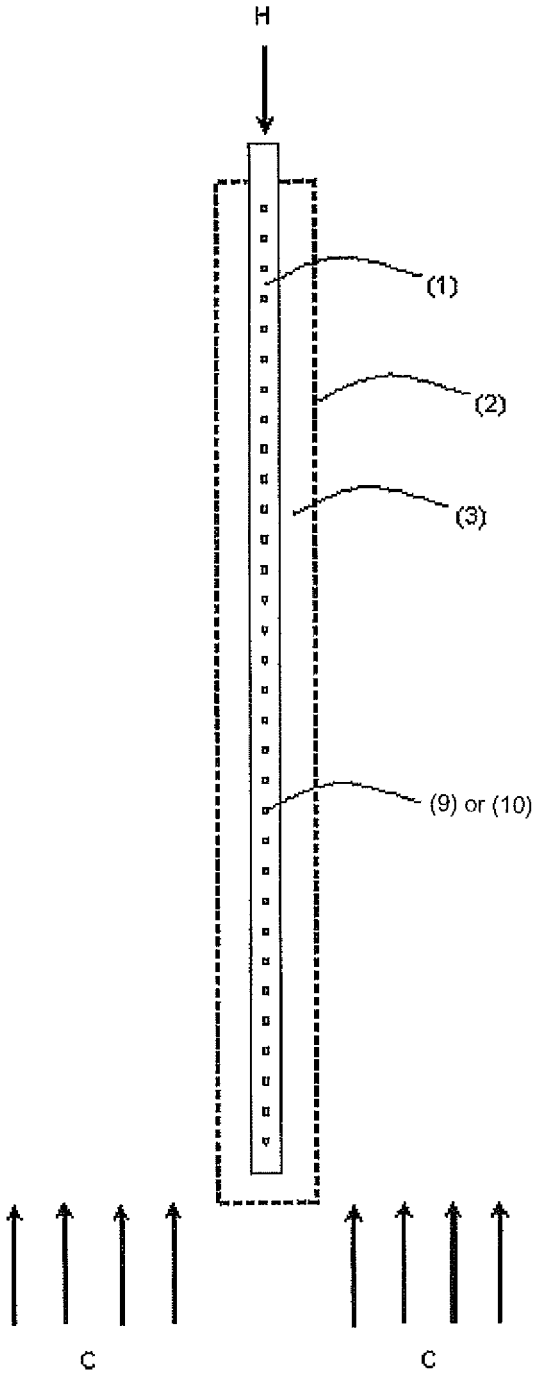
FIG. 1 shows a view of the burner according to the invention in its single tube version.
Figure 2:
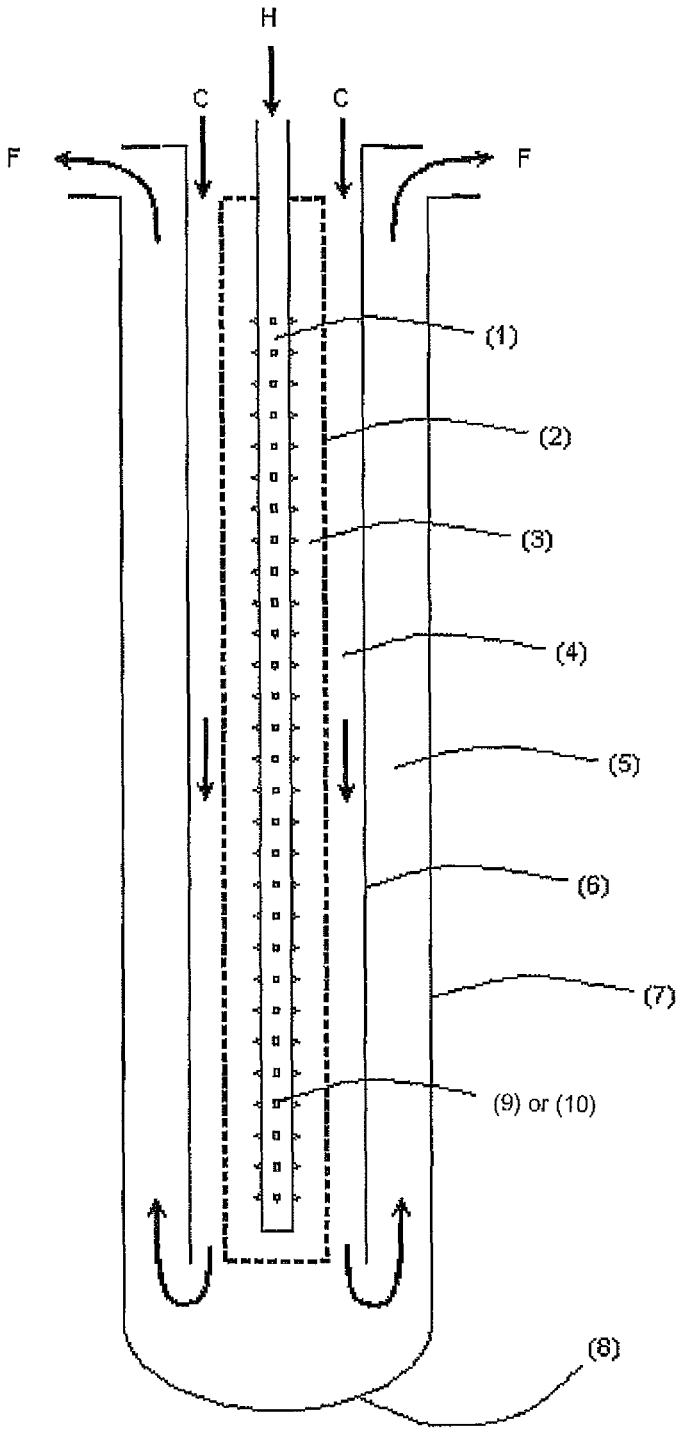
FIG. 2 shows a view of the burner according to the invention in a more improved version in which the oxidizer is introduced into a first space that is adjacent to the porous element, and the smoke that originates from combustion is recovered in a second space that surrounds the first space.

The detailed description of the burner according to the invention is carried out by means of FIG. 1 in the basic version and FIG. 2 in the detailed version.

Figure 3:
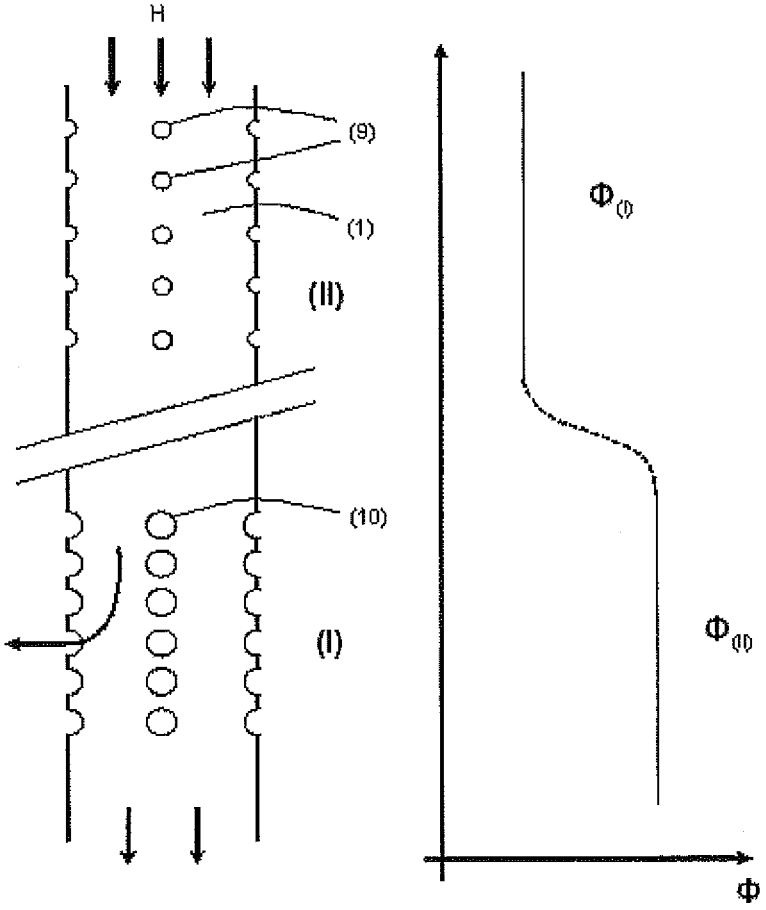
FIG. 3 shows a more specific view of the fuel distributor and an example of a resulting thermal flux profile.

FIG. 3 provides a more specific view of the fuel distributor and is applicable both in the basic configuration and in the improved configuration.

The numbers that are used are the same when they designate the same elements, regardless of the figure.

The burner in its basic version comprises:

a) A central fuel distributor (1) that comprises a certain number of orifices (9) grouped in a family, whereby a family corresponds to a given orifice diameter.

The distributor will generally have a cylindrical shape with an L/D ratio of between 10 and 500.

Within the framework of this invention, this distributor is fed by the fuel that is available at a pressure that is preferably between 0.1 and 10 MPa.

The fuel can be any fuel gas that contains hydrogen in any proportion and optionally can be pure hydrogen.

b) A porous element (2) of annular shape that surrounds the central distributor at least over the entire length of said distributor and that has a thickness of between 0.1 and 2 cm, whereby the distance that separates the distributor from the inner surface of the porous element is between 0.5 and 10 cm. The inner surface is defined as being that which is the closest to the distributor.

The porous element surrounds the distributor in the direction where it has at least the same length as the distributor, and in some cases, a longer length that makes it possible to free a space between the end of the distributor and the internal wall of said porous element that makes it possible to improve the degree of combustion of the combustion gas.

The porosity of the porous element is at least 50% and preferably more than 80%. Said porosity is defined as the ratio of the empty volume to the geometric volume of any portion of the porous element.

This porosity is generally homogeneous over the entire length of the porous element, but it is possible to differentiate it in certain elements of length. For example, it is possible to have a first fraction of the length of the porous element with a porosity P1 and a second fraction of the length of the porous element with a porosity P2 that is different from P1.

This porous element will typically consist of a metallic foam that is made from an alloy of various metals, including, for example, iron, chromium, aluminum, titanium or zirconium, and in some cases yttrium. An example of such an alloy is the material FeCrAlY that is marketed by the PORVAIR Company. The porous element can also consist of a ceramic foam, for example made of mullite or cordierite.

The size of the pores is generally between 0.2 and 0.6 mm.

The space that separates the distributor (1) from the porous element (2), called annular space (3), plays an important role in the operation of the burner according to the invention since the fuel that is obtained from the distributor has a certain longitudinal profile of the flow that it should retain as well as possible at the intake in the porous element. To do this, the linear speed of the fuel inside the annular space should preferably have an adequately high value, since it is known that speeds that are too low would promote the longitudinal diffusion of the fuel inside the annular space (3).

Furthermore, production of combustion inside the porous element or close to its outer surface is generally more easily carried out when the speed of the fuel inside the porous element preferably remains higher than the diffusion rate of the oxidizer.

Preferably, the speed of the fuel still should not exceed a limit value to allow the oxidizer to diffuse inside the porous element.

Taking into account these two conditions and optimizing them lead to adopting a speed of the fuel at the inlet of the porous element of between 2 mm/s and 1.0 m/s, and preferably between 0.5 cm/s and 10 cm/s. This speed is specifically defined as the speed taken along an axis that is perpendicular to the longitudinal axis of the burner, which will conventionally be called radial speed. This speed is therefore nominal at the surface of the porous element.

In the improved version of the burner according to the invention, the outer volume at the porous element (2) is divided by means of a wall (6) that is essentially parallel to the outer surface of the porous element (2) and that has an approximately cylindrical shape into a first space (4) between the outer surface of the porous element (2) and said wall (6) and a second space (5) that corresponds to the volume located outside the wall (6).

This outer volume at the wall (6) can be limited by a second wall (7) that is approximately parallel to the wall (6) and that delimits the second space (5) between said wall (6) and said wall (7). Preferably, this second space (5) will be a space that communicates with the first space (4) by its lower portion, whereby the approximately vertical wall (7) is then connected to an approximately horizontal wall (8), and whereby the walls (7) and (8) then constitute a chamber that encloses the burner according to the invention.

In the detailed version of the burner according to this invention, the oxidizer is allowed into the space (4) and joins the fuel inside the porous element (2) or close to the outer surface of said porous element (2) by producing combustion that generates combustion gases that are found in the first space (4) and are evacuated by passing into the second space (5).

Preferably, the linear speed of the oxidizer that is introduced into the space (4) is between 1 and 100 m/s and preferably between 3 m/s and 80 m/s, and the linear speed of circulation of the combustion gases in the space (5) is preferably between 2 and 150 m/s.

Example that Illustrates the Invention

The following example is intended to demonstrate the effects of the burner according to the invention from the standpoint of the fuel consumption and the temperature in a direction that joins the centers of the burner and the tube that is intended to be heated.

In the application of the burner in the heating of the tubes of a methane steam-reforming reactor, the geometric configuration is shown in FIG. 4.

Tubes (T) that contain the fluid to be heated and burners according to the invention (B) are placed in a quincunx with a square pitch.

The distance that separates the center of the burner from the center of the tube to be heated is 210 mm.

The length of the burners is 12 meters, whereby the distributor of each of the burners has a length of 10 meters.

The L/D ratio of each burner is 120.

The distance between the distributor and the inner wall of the porous element is 15 mm.

The thickness of the porous element is 1 cm.

The distributor is divided into 10 sections with a length of 1 m. Each section generates a total surface area of the orifices that are placed on the section being considered.

A section is defined as a distributor portion that has orifices of the same diameter.

The total surface area of the distribution orifices is specified in Table 2 in 2 cases:

Case 1 corresponds to orifices of uniform size throughout the distributor. The surface area of the set of orifices corresponding to a 1 m section is 15.7 $cm^2$. This case does not correspond to the invention. It is provided by way of comparison.

Case 2 (according to the invention) corresponds to orifices of increasing size in the longitudinal distance of the burner, whereby the increase in the total surface area of the orifices from one section to the next is exponential in nature. This case corresponds to the invention.

The flow rates of reagents and the conditions of temperature and pressure are indicated in Table 1.

FIG. 5 shows that in the first case, the radial speed (Ur) of the fuel on the outer surface of the porous element has a significant variation along the longitudinal axis (d) of the burner. The curve that corresponds to the first case is in dotted lines in FIG. 5.

In the second case, because of the law of distribution of the orifices, the radial speed (Ur) of the fuel is much more homogeneous along the longitudinal axis (d) of the burner. This better homogeneity of the radial speed (Ur) ensures a heat flow that is essentially constant all along the tube. The curve that corresponds to this second phase is in solid lines in FIG. 5. This point is particularly important with tubes whose length is 12 meters.

FIG. 6 shows the changes in the consumption of hydrogen Y(H2) in the direction that joins the center of the burner to that of the tube to be heated, said center-to-center direction. The origin of the distances (r) in this direction is conventionally selected on the outer surface of the porous element of the burner being considered. The values Y(H2) are read off on the ordinate on the left of FIG. 6.

FIG. 6 shows that the amount of hydrogen Y(H2) decreases quickly in the center-to-center direction. Virtually 90% of the hydrogen that is introduced is consumed over a distance of 10 mm, which means, consequently, that the combustion zone is located close to the porous element. This is therefore a case of highly localized combustion.

FIG. 6 also shows (on the right of FIG. 6) the changes in the temperature T of the combustion gases in the center-to-center direction (O° C.=273 K).

This temperature offers a maximum of 1800 K close to the outer surface of the porous element, or, in the case of the example, at 10 mm from said outer surface. The temperature T then decreases until reaching a value that is less than or equal to 1200 K. This value is compatible with non-refractory materials, which is particularly advantageous in the selection of the metallurgy of tubes and in the efficiency of the process.

TABLE 1

| | Oxidizer | Fuel |
|---|---|---|
| Absolute Pressure (MPa) | 0.43 | 0.43 |
| Mass Rate (kg · s − 1) | 1.084 | 0.00848 |
| Intake T (° C.) | 800 | 800 |
| Composition (% by Mass) | 14.6% $O_2$ | 47.8% $H_2$ |
| | 8.8% $H_2O$ | 25.7% $CH_2$ |
| | 1.4% $CO_2$ | 1.7% CO |
| | | 23.0% $CO_2$ |

TABLE 2

| | Section | | | | | | | | | |
|---|---|---|---|---|---|---|---|---|---|---|
| | 0-1m | 1-2m | 2-3m | 3-4m | 4-5m | 5-6m | 6-7m | 7-8m | 8-9m | 9-10m |
| Total Surface Area of Holes in the Section, Case 1 ($cm^2$) | 16.7 | 15.7 | 15.7 | 15.7 | 16.7 | 15.7 | 15.7 | 15.7 | 15.7 | 16.7 |
| Total Surface Area of Holes in the Section, Case 2 ($cm^2$) | 1.57 | 3.45 | 5.12 | 7.59 | 11.3 | 16.7 | 24.8 | 36.7 | 54.4 | 80.7 |

The invention claimed is:

1. A premixing-less hydrogen burner comprising: a central hydrogen distributor of length L and diameter D, with an L/D ratio of between 10 and 500, with a cylindrical geometry and with a non-uniform orifice distribution; and a porous element of a porous material of annular shape that surrounds the central distributor at least over the central distributor's entire length L, said length L being between 2 and 15m , whereby the thickness of said porous element is between 0.1 and 2 cm, and whereby the inner surface of said porous element is located at a distance from the central distributor of between 0.5 cm and 10 cm, the central distributor being divided into at least two sections, wherein the diameter of all of the orifices in sections with greater axial distance along the distributor in the direction of flow of the fuel is greater than the diameter of all of the orifices in sections with a lesser axial distance along the distributor in the direction of flow of the fuel, such that the sections with the greater axial distance along the distributor generates greater heat flux, said orifices of the same section having a center-to-center distance between 0.5 cm and 50 cm.

2. A premixing-less hydrogen burner according to claim 1, in which the central distributor divided into at least two sections, whereby each section has orifices of increasing diameter according to a law that is exponential in nature in the direction of flow of the fuel.

3. A premixing-less hydrogen burner according to claim 1, in which the porous element has a porosity of at least 50%.

4. A premixing-less hydrogen burner according to claim 1, in which the porous element has at least two zones of different porosity.

5. A premixing-less hydrogen burner according to claim 1, comprising hydrogen in the central distributor at a pressure of between 0.1 and 10 MPa.

6. A premixing-less hydrogen burner according to claim 1, comprising oxidizer in a first annular space that surrounds the porous element of the burner, and combustion gases in a second annular space that surrounds the first annular space.

7. A premixing-less hydrogen burner according to claim 1, further including means for circulating oxidizer in a direction that is approximately parallel to a longitudinal axis of the burner at a speed of between 1 m/s and 100 m/s.

8. A premixing-less hydrogen burner according to claim 1, further including means to provide a, mean radial speed of fuel that is related to the inner surface of the porous element of between 2 mm/s and 100 cm/s.

9. A premixing-less hydrogen burner according to claim 1, in which the distributor is divided into a certain number of sections, whereby the length of each section varies from 10 mm to 2 m.

10. A hydrogen burner according to claim 1, having an L/D ratio between 30 and 300.

11. A hydrogen burner according to claim 1, wherein the length L is between 5 and 12 meters.

12. A hydrogen burner according to claim 1, wherein the center-two-center distance is between 1 cm and 20 cm.

13. A hydrogen burner according to claim 3, wherein the porous element has a porosity of at least 80%.

14. A hydrogen burner according to claim 7, wherein the speed of the oxidizer is 3 to 80 m/s.

15. A hydrogen burner according to claim 8, wherein the speed of the fuel is between 0.5 cm/s and 10 cm/s.

16. A hydrogen burner according to claim 9, wherein the length of each section varies from 20 mm to 1.5 m.

17. A premixing-less hydrogen burner comprising: a central hydrogen distributor of length L and diameter D, with an L/D ratio of between 10 and 500, with a cylindrical geometry and with a non-uniform orifice distribution; and a porous element of a porous material of annular shape that surrounds the central distributor at least over the central distributor's entire length L, said length L being between 2 and 15m, whereby the thickness of said porous element is between 0.1 and 2 cm, and whereby the inner surface of said porous element is located at a distance from the central distributor of between 0.5 cm and 10 cm, the central distributor being divided into at least two sections, wherein the diameter of all of the orifices in sections with greater axial distance along the distributor in the direction of flow of the fuel is greater than the diameter of all of the orifices in sections with a lesser axial distance along the distributor in the direction of flow of the fuel, such that the sections with the greater axial distance along the distributor generates greater heat flux, said orifices of the same section having a center-to-center distance between 0.5 cm and 50 cm, and wherein all of the orifices in each section are the same size.

* * * * *